United States Patent [19]

Pigott

[11] 4,135,849

[45] Jan. 23, 1979

[54] PINNED ROOT TURBINE BLADE PROVIDING MAXIMUM FRICTION DAMPING

[75] Inventor: Ronald Pigott, Aston, Pa.

[73] Assignee: Westinghouse Electric Corp., Pittsburgh, Pa.

[21] Appl. No.: 761,046

[22] Filed: Jan. 21, 1977

[51] Int. Cl.[2] ..... F01D 5/14

[52] U.S. Cl. ..... 415/119; 416/217; 416/500

[58] Field of Search ..... 415/119; 416/217, 500

[56] References Cited

U.S. PATENT DOCUMENTS

| | | | |
|---|---|---|---|
| 1,289,278 | 12/1918 | Schmidt | 416/217 |
| 1,345,642 | 7/1920 | Schmidt | 416/217 |
| 1,362,074 | 12/1920 | Baumann | 416/217 |
| 2,625,366 | 1/1953 | Williams | 416/217 |
| 2,635,848 | 4/1953 | McDowell | 416/217 |
| 2,790,620 | 4/1957 | Rankin | 416/217 |
| 2,999,668 | 9/1961 | Howald et al. | 416/217 |
| 3,043,563 | 7/1962 | Gray et al. | 416/217 |
| 3,554,668 | 1/1971 | Wagle | 416/217 |

FOREIGN PATENT DOCUMENTS

| | | | |
|---|---|---|---|
| 667979 | 3/1952 | United Kingdom | 416/217 |
| 200107 | 10/1967 | U.S.S.R. | 416/217 |

*Primary Examiner*—C. J. Husar
*Attorney, Agent, or Firm*—J. W. Keen

[57] ABSTRACT

A pinned root blade having a predictable center of rotation when tangentially oscillated and also having a predetermined, axial contact surface which is engageable with a rotatable rotor and which is disposed about the center of rotation in such manner as to provide maximum friction damping of the tangential oscillations.

5 Claims, 4 Drawing Figures

PINNED ROOT TURBINE BLADE PROVIDING MAXIMUM FRICTION DAMPING

BACKGROUND OF THE INVENTION

This invention relates to rotatable turbine blades and more particularly to pinned root blades having friction damping means provided therefor.

Pinned root blades are often used in the first or control stage of high pressure turbine elements. It is believed that pinned root blades have better load carrying capabilities than "Christmas Tree" root blades and "T" root blades when they are subjected to partial admission shocks which often occur at the control stage. Pinned root blades are also easily removed and replaced if such action is required. Axial contact faces on pinned root blades which engage the attached rotor are presently flat, single planes. However, because of tolerances on smoothness, the actual contact surfaces may be anywhere on the assumed contact faces. If the actual contact area occurs at or near the center of rotation of the pinned root, the friction damping effect obtained by the pinned root blade's axial surfaces rubbing against the attached rotor is almost neglibible. Since friction damping is a part of net damping and vibratory stresses in the pinned root blade decrease as the net damping increases, minimizing total blade stress necessitates maximizing the friction damping.

Maximum friction damping occurs when the actual contact area on one axial end of the pinned root blade is located as far as possible from the center of rotation of the blade's root. Thus, it is necessary to be able to predict the center of rotation of the blade's root. Additionally, the frictional contact needs only be on the blade root's low pressure side since rotatable blades in axial flow turbines experience an axial force which is toward the axially low pressure side of the blade.

Presently, because the actual contact area is unknown, high blade stress due to low friction damping may cause the blade to fail or behave in an unpredictable manner due to the unknown distribution of the actual contacting surfaces.

SUMMARY OF THE INVENTION

In general, an axial flow turbine having a rotatable rotor, at least one casing surrounding the rotor, at least one axial row of stationary blades disposed circumferentially around the rotor, at least one axial row of rotatable blades which are disposed about the circumference of the rotor and are separatable into arcuate, circumferential sections, means for attaching each of the arcuate, circumferential blade sections to the rotor so that each arcuate blade section is tangentially oscillatable about a known rotation point, and means for frictionally damping the tangential oscillations at maximumly effective contact locations between the rotor and the arcuate blade sections. The arcuate blade sections are frictionally damped against tangential oscillations by having an axially directed and protruding annulus situated on the low pressure side of each arcuate section so that, during turbine operation when a fluid is passing therethrough and the rotor is rotating, the arcuate blade section's root portions will be forced axially into rubbing contact with the attached rotor. The protruding annulus on each arcuate blade section's root becomes a maximumly effective contact surface for frictionally damping tangential oscillations when it is situated at the greatest possible radial distance from the rotation point. The maximum radial distance from the rotation point is limited by the circumferential extremes of each blade section's root, the platform portion of each blade section, and the radially inner end of the root portion. The root portion of each blade section is divided into a plurality of root sections, each of which has a contact annulus formed on its axial low pressure side. Each contact annulus provides a known, engaging surface which promotes uniform mechanical performance for all arcuate blade sections, reduces blade stresses by maximizing friction damping, and simplifies blade stress and performance calculations.

BRIEF DESCRIPTION OF THE DRAWINGS

The objects and advantages of this invention will become more apparent from reading the following detail description in connection with the accompanying drawings, in which.

DESCRIPTION OF THE PREFERRED EMBODIMENT

Figure 1:
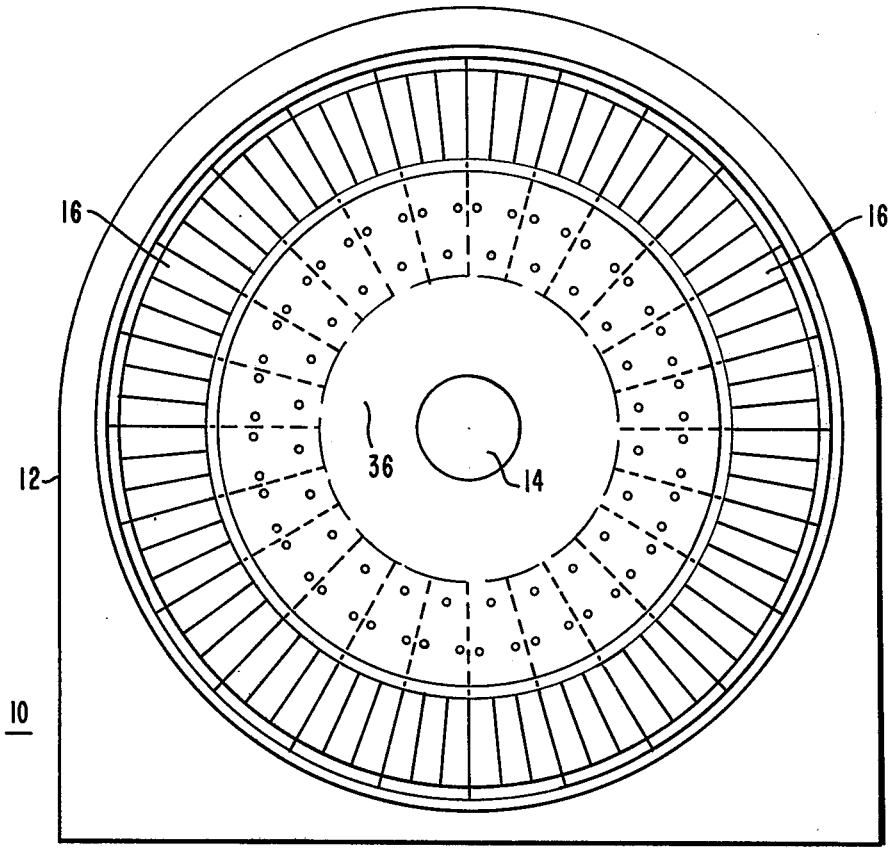
FIG. 1 is an axial section view of an axial flow turbine made in accordance with this invention.

Referring now to the drawings in detail, FIG. 1 shows a sectional view of an axial flow steam turbine 10 having a casing 12 which surrounds a rotatable rotor 14 having a plurality of arcuate, circumferential blade sections 16 attached thereto.

Figure 2:
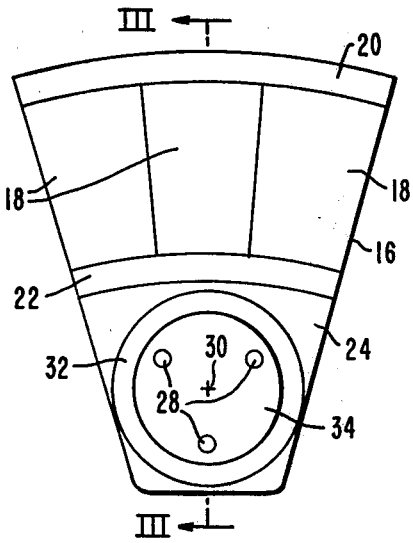
FIG. 2 is an enlarged view of an arcuate, circumferential blade section illustrated in FIG. 1.
Figure 3:
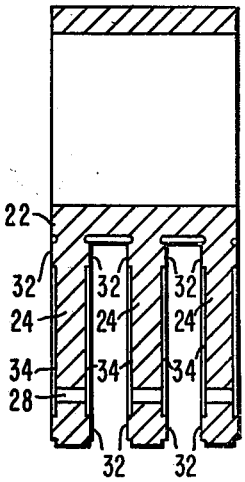
FIG. 3 is a sectional view taken on line III—III of FIG. 2.
Figure 4:
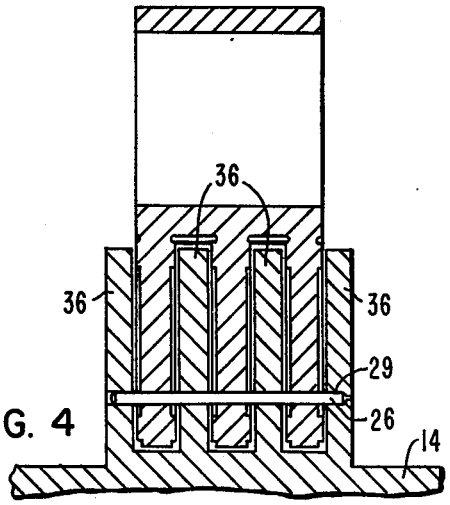
FIG. 4 is a sectional view of the rotor and an attached blade section.

A single arcuate blade section 16 is illustrated in FIG. 2 and is made up of three individual vanes 18 which have common tip portions 20, a common platform portion 22, and a three-pronged root section 24 which is better illustrated in FIG. 3. A securing pin 26, better illustrated in FIG. 4, is receivable in each of the three openings 28 which extend axially through blade root prongs 24. Blade sections 16 are secured to rotor 14 by passing pins 26 through holes 29 in the disc portion and through openings 28 with the holes and openings being in general alignment.

The three securing pins 26 are inserted with an interference fit and cause blade section 16, when subjected to tangential oscillations, to rotate slightly about rotation point 30. Effective damping of the tangential oscillations is obtained by forming an annulus 32 on both axial faces of each blade root prong 24 with annulus 32 extending axially beyond the remainder of prong 24'axial faces 34. The outer radius of annulus 32 is chosen to be the greatest radius inscribable about rotation point 30 on the axial face of prong 24 with the inner radius of annulus 32 being sufficiently smaller to allow for an effective friction damping surface area. The inner radius presently is chosen to be equal to ¾ the outer radius. The axial protrusion of annulus 32 above prong face 34 should be sufficiently large to ensure full axial contact with disc extensions 36 on rotor 14 when blade section 16 passes fluid flow therethrough. The protrusion height, however, must be maintained at a relatively small value in order to prevent pins 26 from being subected to abnormally large bending stresses. Accordingly, the protrusion height of annulus 32 above prong face 34 is, by example, held to a minimum of 0.01 inches and a maximum of 0.02 inches. While annulus 32 is shown disposed on both axial sides of each prong 24, it is to be understood that the contact annulus needs only be formed on the axially low pressure side of a single prong 24. Formation of annuli on each prong 24 is due to manufacturing tolerances and the ability to predict which prong will axially contact the rotor. The illustrated embodiment having annulus 32 on both axial sides of each prong 24 was chosen to provide a more uniform manufacturing process and to account for the possibility that blade section 16 may have its axial low pressure side on either of the axial sides. Such behavior may originate from a variety of causes including off-design operating conditions.

The axial protrusion of annulus 32 above prong face 34 provides an actual axial contact surface so that when blade section 16 is axially displaced a small distance by the force of fluid flowing therethrough, tangential oscillations about rotation point 30 are frictionally damped a known and predictable amount by annulus 32 axially contacting a disc extension 36. Thus, mechanical performance of all blade sections 16 is made more uniform while reducing the blade stress therein and simplifying the blade stress calculations. Although annulus 32 has been shown as the axial contact surface, other suitable shapes of axial protrusion could be substituted therefor with those shapes being chosen so as to promote effective friction damping and maintain uniform mechanical performance of that blade section.

I claim:

1. An axial flow turbine comprising:

a rotatable rotor;

at least one axial row of rotatable blades, each of said blades having a root portion and a tip portion radially directed from and circumferentially disposed about said rotor with at least one axial row of said rotatable blades being separatable into arcuate, circumferential sections;

means for securing each of said arcuate blade section's root portions to said rotor so that each of said sections is tangentially oscillatable about a known rotation point; and axially protruding contact locations disposed on the axially low pressure side of said blade root portions, said contact locations being radially separated from the known rotation point and being axially engageable with the rotor.

2. The axial flow turbine of claim 1, said securing means comprising:

at least one pin axially inserted through said blade section's root portion and a radial extension of said rotor, said pin causing relative circumferential rotation between said rotor extension and said blade section to be about said rotation point.

3. The axial flow turbine of claim 2, wherein said pins are disposed in said blade root portion and rotor extension in a triangular arrangement when viewed from an axial end of said rotor with said rotation point lying at the center of the resulting triangle.

4. The axial flow turbine of claim 1, wherein said contact locations comprise an annulus which is situated at the maximum distance from said rotation point whereby said tangential oscillations are more effectively damped.

5. The axial flow turbine of claim 4, wherein said root portions comprise a plurality of axially adjacent radial extensions of said arcuate blade sections, each of said extensions having at least one axially directed opening therethrough.

* * * * *